United States Patent [19]

Sturwold

[11] Patent Number: 4,675,125

[45] Date of Patent: Jun. 23, 1987

[54] MULTI-PURPOSE METAL CLEANING COMPOSITION CONTAINING A BORAMIDE

[75] Inventor: Robert J. Sturwold, Cincinnati, Ohio

[73] Assignee: Cincinnati-Vulcan Company, Cincinnati, Ohio

[21] Appl. No.: 864,781

[22] Filed: May 19, 1986

Related U.S. Application Data

[63] Continuation-in-part of Ser. No. 627,452, Jul. 2, 1984, abandoned.

[51] Int. Cl.[4] ..... C11D 3/30; C11D 9/30; C23G 1/20; C23G 1/26

[52] U.S. Cl. ..... 252/118; 252/111; 252/117; 252/132; 252/153; 252/173; 252/174.15; 252/174.21; 252/392; 252/525; 252/529; 252/544; 252/548

[58] Field of Search ..... 252/111, 117, 118, 132, 252/173, 174.21, 153, 525, 529, 544, 548, 389 R, 392, 174.15

[56] References Cited

U.S. PATENT DOCUMENTS

| | | | |
|---|---|---|---|
| 3,024,197 | 3/1962 | Dohr | 252/117 |
| 3,429,909 | 2/1969 | Schuster | 260/404 |
| 3,870,647 | 3/1975 | Travers | 252/118 |
| 4,022,713 | 5/1977 | Waldstein | 252/389 R |
| 4,060,496 | 11/1977 | Berliner | 252/171 |
| 4,176,076 | 11/1979 | Waldstein | 252/49.6 |
| 4,201,686 | 5/1980 | Augustijn | 252/174.22 |
| 4,226,734 | 10/1980 | Schuster | 252/49.3 |
| 4,285,840 | 8/1981 | Fricker | 252/546 |
| 4,395,352 | 7/1983 | Kulkarni | 252/321 |
| 4,465,619 | 8/1984 | Boskamp | 252/540 |

OTHER PUBLICATIONS

Fette, C. J.: "Sodium Replacement–The State of the Art", *Lubrication Engineering,* Nov. 1979, pp. 625–627.

"New Oil Additive Technology–Part 2: Metalworking Coolants", *Fluid & Lubricant Ideas,* Jan./Feb. 1981, pp. 7–10.

*Primary Examiner*—Dennis L. Albrecht

[57] ABSTRACT

Improved multi-purpose metal cleaning compositions are provided comprised of 5 to 40 parts by weight ethoxylated aliphatic alcohol or ethoxylated alkylphenol, 4 to 20 parts by weight alkanolamine salt of a fatty acid, 2 to 15 parts by weight boramide, 2 to 15 parts by weight alcohol, glycol or ether glycol, 0.05 to 2.5 parts by weight antifoam agent, and 5 to 98 parts by weight water. In addition to being highly effective cleaners for the removal of grease, oil, dirt, scale and metal fines, the compositions of this invention also provide a non-sticky and non-greasy corrosion-resistant protective barrier on the surface of the metal.

8 Claims, No Drawings

MULTI-PURPOSE METAL CLEANING COMPOSITION CONTAINING A BORAMIDE

CROSS REFERENCE TO RELATED APPLICATION

This is a continuation-in-part of copending application Ser. No. 627,452, filed July 2, 1984, now abandoned.

BACKGROUND OF THE INVENTION

This invention relates to compositions useful for cleaning metal surfaces. More particularly, the invention relates to water-based compositions which in addition to cleaning the surface of metals when applied thereto also have other desirable properties which make them highly useful for industrial metal-working applications.

The need to clean the surface of metals subsequent to various metal working operations is well known. For example, parts obtained from machining operations are cleaned to remove metal fines, residual cutting oil, dirt. etc. Similarly the surface of metal sheet obtained from rolling operations is generally cleaned after the final reduction and prior to the application of slushing oils or coating oils which are employed to protect the surface of the metal sheet during coiling and subsequent storage. In tandem mills where the metal sheet is continuously passed in one direction through multiple stands which progressively reduce the thickness of the metal, the last stand is primarily employed to impart the desired surface quality to the metal, i.e., smooth, polish and clean the metal surface. It is at this point in the rolling operation where cleaners are applied to the metal to remove any residual rolling oil, dirt and scale. After the cleaning operation the metal sheet is coiled for shipment or storage. If a slushing or coating oil is required to protect the metal during shipment/storage, the protective oil is applied after the cleaning step and before coiling.

Highly alkaline detergent solutions (pH 9.5 or higher) have been used almost exclusively as cleaners. These typically contain alkali phosphates, alkali carbonates, alkali silicates, caustic soda or combinations thereof in conjunction with a surfactant. for example, a composition suitable as a metallic cleaning agent comprised of water, a Group IA or IIA metal hydroxide and at least one sulfur-containing compound selected from trimethylene ring sulfur compounds, mercapto alkanones and dialkylaminoalkyl dithiocarbamic acids are disclosed in U.S. Pat. No. 4,400,312. Sulfur-based aqueous metal cleaners are similarly employed in U.S. Pat. No. 4,421,667. The cleaners of U.S. Pat. No. 4,421,667 contain 80–99.5 weight percent water, 0.1–5 weight percent water soluble surfactant, 0.1–5 weight percent Group IA or IIA metal hydroxide and 0.25–10 weight percent thiomorpholine compound. The cleaning and degreasing compositions of U.S. Pat. No. 4,421,680 contain potassium hydroxide and sodium metasilicate pentahydrate in combination with n-butoxyethanol, coconut diethanolamide, cocamidopropyl betaine, isopropylamine salt of dodecylbenzenesulfonic acid and water.

Due to the problems associated with handling and disposal of highly alkaline metal cleaning materials, there is a need for products which are effective for degreasing and cleaning metal surfaces but which do not include strongly alkaline detergents. One such product, comprised of an aqueous solution containing 3–20 parts fatty acid sucrose ester, 3–15 parts polyoxyethylene alkyl ether, 1–10 parts chelating agent, 1–5 parts petroleum sulfonate and 3–10 parts propylene glycol, is described in U.S. Pat. No. 4,395,365. The products of U.S. Pat. No. 4,395,365 are considerably less alkaline (pH about 8 to 8.5) and utilize organic surface-active agents which are harmless to the human body and can be decomposed by microorganisms. The inclusion of a chelating agent also imparts some rust- and corrosion-inhibiting ability to the cleaners of U.S. Pat. No. 4,395,365.

U.S. Pat. No. 3,870,647 discloses concentrated liquid detergent cleaners containing propylene glycol, a small amount of monoethanolamine, fatty acids and ethoxylates. The cleaners are primarily useful as laundry detergents but also suggested to be useful for the removal of oils and greases and for cleaning hard surfaces.

It would be highly advantageous if other aqueous compositions having moderate pH and which are effective cleaners for metal surfaces were available. It would be even more advantageous if the cleaners also provided a non-greasy and non-sticky protective barrier on the surface of the metal to prevent rust and corrosion during storage and shipping. These and other advantages are realized with the improved multi-purpose metal cleaning compositions of the present invention.

SUMMARY OF THE INVENTION

In accordance with the above objectives, there is now provided improved multi-purpose metal cleaning compositions comprised of 5 to 40 parts by weight ethoxylated aliphatic alcohol or ethoxylated alkylphenol, 4 to 20 parts by weight alkanolamine salt of a fatty acid, 2 to 15 parts by weight boramide, 2 to 15 parts by weight alcohol, glycol or ether glycol, 0.05 to 2.5 parts by weight antifoam agent, and 5 to 98 parts by weight water.

The ingredients are readily compatible and when combined in the proportions indicated provide a cleaner concentrate which can be used as such or further diluted with water. The aqueous cleaner compositions of this invention are highly effective cleaners for the removal of residual oil, dirt, scale, metal fines from metal surfaces. They further provide a rust- and corrosion-resistant protective coating on the surface of the metal and have other desirable properties which will be described more fully to follow.

Particularly effective compositions of the invention contain 10 to 30 parts by weight ethoxylated aliphatic alcohol or ethoxylated alkyphenol, 6 to 16 parts by weight alkanolamine salt of a fatty acid, 3 to 10 parts by weight boramide, 3 to 10 parts by weight alcohol, glycol or ether glycol, 0.1 to 1.0 parts by weight antifoaming agent, and 33 to 96 parts by weight water.

DETAILED DESCRIPTION OF THE INVENTION

The improved multi-purpose metal cleaning compositions of this invention are comprised of 5 to 40 parts by weight ethoxylated aliphatic alcohol \or ethoxylated alkylphenol, 4 to 20 parts by weight alkanolamine salt of a fatty acid, 2 to 15 parts by weight boramide, 2 to 15 parts by weight alcohol, glycol or ether glycol, 0.05 to 2.5 parts by weight antifoam agent, and 5 to 98 parts by weight water.

The ethoxylated aliphatic alcohols and ethoxylated alkylphenols which are used are commercially available products widely recognized for their surface-active properties. Such nonionic surfactants are readily obtained by condensing the aliphatic alcohol or alkylphenol with ethylene oxide in accordance with conventional procedures. The degree of ethoxylation is controlled by the molar excess of ethylene oxide charged to the reactor. For example, ethoxylated (6 E.O.) nonylphenol indicates that 6 moles ethylene oxide is reacted per mole of nonylphenol.

Ethoxylated products useful for the metal cleaning compositions of the present invention generally have from 6 to 18 moles ethylene oxide condensed with the aliphatic alcohol or alkylphenol. Aliphatic alcohols from which the ethoxylates are obtained can be branched- or straight-chain and contain from 6 to 18 and, more preferably, 8 to 16 carbon atoms.

Alkylphenols employed to obtain the ethoxylates may contain up to three alkyl substituents which can be the same or different. Most generally, the alkylphenol has a single $C_{6-18}$ alkyl substituent and, more preferably a single $C_{8-16}$ alkyl group. The preferred aromatic ethoxylates are described by the general formula

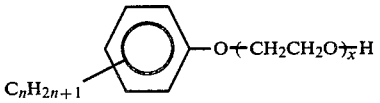

where n is an integer from 6 to 18, and x is an integer from 6 to 16. Especially useful ethoxylated aliphatic alcohols and ethoxylated alkylphenols contain 8 to 12 moles condensed ethylene oxide, i.e., x is equal to 8–12.

The second component of the metal cleaning composition is an alkanolamine salt of a $C_{10-22}$ fatty acid. Fatty alkanolamine salts employed for the present invention are any of the known products used in metal working and lubricating fluids. The fatty acid alkanolamine salts are obtained by simply combining the fatty acid and alkanolamine and stirring for a short period of time. Depending on the particular fatty acid and alkanolamine used, it may be advantageous or even necessary in some instances to moderately heat the mixture. The fatty alkanolamine salt may be preformed and added to the other essential components of the metal cleaner or essentially stoichiometric amounts of the fatty acid and alkanolamine may be combined with the other components and the fatty alkanolamine salt formed in situ during the blending operation.

Fatty acids from which the alkanolamine salts are produced are aliphatic monocarboxylic acids having from 10 to 22 and, more preferably, 12 to 18 carbon atoms. The fatty acids may be saturated or can contain unsaturation and can be straight-chain or branched. The fatty acids generally consist of a mixture of acids of the above types, such as are obtained by splitting fats and oils. Particularly useful monocarboxylic acids include lauric acid, myristic acid, palmitic acid, stearic acid, oleic acid, linoleic acid, linolenic acid, arachidic acid, behenic acid and mixtures thereof. The alkanolamine may be selected from any of the group consisting of monoethanolamine, diethanolamine, triethanolamine, monoisopropanolamine, diisopropanolamine, triisopropanolamine, mono-sec-butanolamine, di-sec-butanolamine and tri-sec-butanolamine.

Boramides obtained by the reaction of an alkanolamine with boric acid are also included in the metal cleaner formulation. Boramides, or amine borates as they are sometimes referred to, are commercially available products known to possess rust-inhibiting properties obtained by the reaction of boric acid ($H_3BO_3$) or its analogs $HBO_2$,$H_2B_4O_7$ and $B_2O_3$ with a molar excess of an aminoalcohol at temperatures typically above 130° C. A solvent is generally used for the reaction to assist in removal of the water of reaction. Carboxylic acids, such as fatty acids, or alcohols are often included with the boric acid and alkanolamine to modify the resulting boramide. Secondary aminoalcohols are typically reacted with the boric acid at a molar ratio of 3:1 to 5:1, however, tertiary aminoalcohols may also be employed. When tertiary aminoalcohols are used they generally make up only a portion of the aminoalcohol charge. Diethanolamine and diisopropanolamine are preferred secondary aminoalcohols for the formation of useful boramides and triethanolamine is the preferred tertiary alkanolamine. For additional details regarding preparation of boramides useful for the formulation of the present metal cleaners, reference may be had to U.S. Pat. No. 3,429,909. Particularly useful boramides are liquid products having viscosities (100° F.) from about 100 to 8000 SUS. The boramides generally have a pH (1% aqueous solution) of about 8.0 to 9.8.

An alcohol, glycol or etherglycol is utilized for the metal cleaners to insure compatibility of the components and prevent separation and/or gellation. Alcohols which are useful include branched- or straight-chain alcohols having 2 to 5 carbon atoms. Ethanol and isopropanol are particularly useful aliphatic alcohols. Glycols (diols) useful for the formulation of the metal cleaners have from 2 to 12 and, more preferably, 2 to 8 carbons. The diols are preferably saturated and can be either straight-chain or branched. Useful diols include ethylene glycol, 1,2- or 1,3-propanediol, 1,2-, 1,3- or 1,4-butanediol, 1,6-hexanediol, 3-methyl-1,5-pentanediol, 2,3-dimethyl-2,3-butanediol, 1,8-octanediol, 2-ethylhexanediol and the like. Ether glycols having from 4 to 8 carbon atoms may also be employed. Such ether glycols include diethylene glycol, triethylene glycol, tetraethylene glycol, monomethylethylene glycol, ethylene glycol monobutyl ether (monobutylethylene glycol), and the like.

Conventional antifoam additives known to the art which have a surface tension lower than that of the cleaner are used in small amounts for the metal cleaner formulations. Typically, the anti-foam agents have a low solubility in the formulation but can be readily dispersed therein. Illustrative antifoaming agents useful for the invention include: substituted phosphates such as ethyl phosphate, tetraoctyl pyrophosphate, ethyl oleyl glycol o-phosphate, and the like; polyol esters such as glycerol monoricinoleate, polyoxyalkylene sorbitan monooleate, diethylene glycol monooleate, diglycol dinaphthenate, and the like; fluorinated hydrocarbons; silicones, such as those obtained hydrolyzing a chlorosilane and then condensing the resulting hydroxysilane, and silicates. Silicone fluids are particularly advantageous in formulating the present metal cleaner compositions in view of their ready availability and high degree of efficiency in reducing foaming.

All of the above ingredients are combined with water in the proportions indicated to obtain the metal cleaner. The cleaner may be obtained as a "concentrate", which can be used as such for certain applications or further diluted with water. For most uses the cleaner will contain a substantial quantity, typically 90–98 percent by weight, water. This is particularly so when the cleaner is applied to metal sheet during rolling operations.

The following examples illustrate the invention more fully but are not intended as a limitation thereof. As will be evident to those skilled the art, numerous variations within the scope of the invention are possible. All parts and percentages in the examples are on a weight basis unless otherwise indicated.

Various test procedures are employed throughout the examples. In the rust test, iron filings (1 gram) are uniformly spread on a piece of 7 cm. filter paper in a Petri dish and covered with 5–10 mls. of the test solution. The filings and paper are examined for rust or rust stains after 24 hours. For the humidity test, clean polished 1×4 inch steel panels (RS-14, Q-Panel Co.) are immersed in the test solution for 15 seconds and allowed to air dry for 30 minutes. The panels are then placed in a humidity chamber and held at 100° F. and 100% relative humidity. After 24 hours the panels are examined for rust.

Foaming characteristics are determined using a 5 percent solution of the product in water. One-hundred mls. of the 5% solution are placed in a 100 ml. graduate cylinder which is stoppered and vigorously shaken for 5–10 seconds. The foam height is measured after 10 seconds. Any foam generated should break, i.e., no foam remaining, within 10 seconds and, if so, is reported as "none".

Anti-wear and extreme pressure properties are measured using a Falex machine in accordance with standard test procedures. Units of wear are determined for the test solutions at a loading of 900 pounds after 15 minutes. The load is then increased at a steady rate until failure which is reported as the extreme pressure (EP) value. The lower the units of wear and the higher the EP values, the more advantageous the product.

Staining is determined using a modification of ASTM Test Procedure F 485 wherein clean polished steel 1×4 inch panels (RS-14, Q-Panel Co.) are partially immersed in a 5% solution of the test sample for 15 seconds. The panels are then allowed to air dry for 15 minutes and placed in an oven at 150° F. for 30 minutes. Differences between the treated and untreated surface of the panel are noted. The effectiveness of the product to clean metal surfaces, i.e., "cleanability", is determined by immersing the steel panels in either 100 SUS naphthenic mineral oil or soybean oil. The panels are allowed to drain for 30 minutes, while suspended, and then immersed for 1 minute in a 5% solution of the test solution maintained at 100° F. with moderate agitation. After the panels are air dried, the surface is visually inspected to determine the extent of oil removal. In some instances, the panels are weighed before and after cleaning to determine the percentage of oil removal.

EXAMPLE 1

A metal cleaning composition was formulated as follows:

| | Percent |
|---|---|
| Ethoxylated (9 E.O.) Nonyl Phenol | 20 |
| Oleic Acid | 5 |
| Triethanolamine | 5 |
| Triethanolamine Borate | 5 |
| Ethyl Glycol Monobutyl Ether | 5 |
| Silicone Antifoam | 0.2 |
| Water | 59.8 |
| Properties: | |

-continued

| | Percent |
|---|---|
| Appearance | Very Slight Haze |
| 100° F. Viscosity | 50.4 centistokes<br>234 SUS |
| Specific Gravity (25° C.) | 1.058 |

The above composition was diluted with water to prepare a 5% aqueous solution (5 parts concentrate in 95 parts water) which was evaluated in accordance with the previously described procedures. Test results obtained with the 5% aqueous solution were as follows:

| | |
|---|---|
| pH | 9.0 |
| Rust Test | No Visible Rust |
| Humidity Test | No Visible Rust |
| Foam | None |
| Falex Test: | |
| Units Wear | 10 |
| EP | 3500 |
| Stain Test | No Spotting or Stain |
| Cleaning Test | No Visible Residue |

It is apparent from the results of the staining and cleanability tests that the aqueous composition is an effective metal cleaning solution. Even though there was no visible residue on the metal after drying, it is evident from the rust and humidity tests that a protective rust-inhibiting barrier is nevertheless present on the surface of the metal.

A variety of commercially available antifoaming agents were employed in the above formulation and all gave comparable foaming characteristics, i.e. the foam broke almost immediately, and did not adversely affect the cleaning, rust-inhibiting or lubricating properties. The anti-foam agents employed (all at 0.2% level) included: Q2-3183A (polymethylsiloxane, propylene glycol, silica manufactured by Dow Corning); DB-100 (compounded Silicone fluid manufactured by Dow Corning); DC-544 (self-emulsifying silicone compound manufactured by Dow Corning); OC-2 (100% silicone anti-foam compound manufactured by Dow Corning); DC-206 (dimethyl siloxane polymer manufactured by Dow Corning); Foamburst 514 (combination silicone/non-silicone type manufactured by Ross Chemical); PC 1344 (ethylacrylate copolymer manufactured by Monsanto); and Mazu DF-313, DF-308 and DF-2501 (all organic diesters manufactured by Mazer Chemical).

EXAMPLES 2 AND 3

Metal cleaning compositions were prepared in accordance with the formulation of Example 1 except that different nonionic surfactants (ethoxylated alcohols and ethoxylated alkylphenols) were employed. The nonionic surfactant and test results obtained with 5% aqueous solutions prepared from the resulting metal cleaning formulations follow:

| | Ex. 2 | Ex. 3 |
|---|---|---|
| Nonionic Surfactant | Ethoxylated (6 E.O.) nonyl phenol | Ethoxylated (9.5 E.O.) tridecyl alcohol |
| Rust Test | Very Slight Rust | Very Slight Rust |
| Humidity Test | No Visible Rust | No Visible Rust |
| Foam | None | None |
| Falex Test: | | |
| Units Wear | 0 | 0 |
| EP | 3250 | 3300 |

-continued

| | Ex. 2 | Ex. 3 |
|---|---|---|
| Stain Test | No Spotting or Stain | No Spotting or Stain |
| Cleaning Test | No Visible Residue | No Visible Residue |

Similar results were obtained using other aliphatic alcohols and alkyl-substituted phenols ethoxylated with from 8 to 16 moles ethylene oxide. However, when the nonionic surfactant was omitted the cleaning efficiency of the products was no longer acceptable. Spotting was evident in the stain test and substantial amounts of both the naphthenic mineral oil and soybean oil remained on the metal test panel in the cleanability test when no ethoxylated aliphatic alcohol or ethoxylated alkylphenol was present.

EXAMPLES 4–8

To demonstrate the versatility of the products of this invention, the metal cleaning compositions of Example 1 were reformulated using different boramides as follows:

Ex. 4—a commercial triethanolamine borate (MONACOR BE) manufactured by Mona Industries, Inc.; Ex. 5—a commercial diethanolamine borate (SYNKAD 202) manufactured by Keil Chemical Division, Ferro Corporation; Ex. 6—a commercial triethanolamine borate (SYNKAD 204) manufactured by Keil Chemical Division, Ferro Corporation; Ex. 7—a laboratory prepared boramide obtained by reacting 0.80 equivalent boric acid and 0.67 equivalent triethanolamine (99%) in Stoddard solvent at 120°–130° C.; Ex. 8—a laboratory prepared boramide obtained by reacting 0.40 equivalent boric acid, 0.09 equivalent oleic acid and 0.95 equivalent triethanolamine in Stoddard solvent at 120°–130° C.

All of the above-prepared compositions were readily soluble in water and provided clear, haze-free 5% aqueous solutions having pH's in the range 7.5–9. All of the products exhibited excellent rust-inhibiting properties. No rust was observed in either the rust test or humidity test with any of the test solutions containing the products of Examples 4–8. Also, none of the metal test panels treated with the solutions in the strain test showed any evidence of stain or any visible residue. All of the solutions were effective cleaners (removing essentially all of the deposited oil) in the cleanability test. Aqueous solutions containing the product of Examples 4 and 8 were evaluated for their lubricating ability in the Falex test and gave favorable results. Units wear and EP values obtained for the aqueous test solutions were 0 and 3600 and 1 and 3600, respectively.

The criticality of the boramide in the formulation was demonstrated by preparing three comparative compositions (A–C) which did not contain an amine borate. The formulations were as follows:

| | Comp. A | Comp. B | Comp. C |
|---|---|---|---|
| Ethoxylated (9 E.O.) Nonyl Phenol | 20 | 15 | 10 |
| Oleic Acid | 5 | 10 | 5 |
| Triethanolamine | 5 | 10 | 5 |
| Ethylene Glycol Monobutyl Ether | 5 | 5 | 5 |
| Silicone Antifoam | 0.2 | 0.2 | 0.2 |
| Water | 64.8 | 59.8 | 74.8 |

Product B was a gel which could not be dissolved in water to provide a useful homogeneous solution. While products A and C were both clear solutions readily compatible with water to obtain 5% aqueous solutions, both gave heavy rusting in the rust and humidity tests.

When the amine borate was not pre-formed but rather the boric acid and triethanolamine added directly to the formulation, i.e. 20 parts ethoxylated (9. E.O.) nonyl phenol, 5 parts oleic acid, 2.5 parts boric acid, 7.5 parts triethanolamine, 5 parts ethylene glycol monobutyl ether, 0.2 part silicone antifoam and 59.8 parts water, heavy rusting occurred with the resulting 5% aqueous solution.

EXAMPLES 9–12

Further variation of the metal cleaning compositions of this invention are evident from the following Examples wherein the fatty acid and alkanolamine components were varied. Details of the compositions and results obtained with the 5% aqueous cleaning solutions prepared therefrom are set forth in Table I. All of the products were useful multi-purpose metal cleaners. In addition to being effective cleaners for the removal of residual rolling oils and metal fines from the surface of metal sheet obtained from metal rolling operations, the products also provided a non-greasy and non-sticky rust-inhibiting protective barrier on the surface of the metal. Similar results were obtained with the product of Example 9 when the stearic acid and triethanolamine were combined to form the salt prior to formulation with the other components.

The need for the fatty acid was demonstrated when Example 9 was repeated substituting adipic acid and isophthalic acid for the stearic acid. In both instances heavy rusting was obtained with the aqueous solutions prepared from the resulting formulations. Substituting cocamine or a mixture of $C_{12-14}$ aliphatic primary amines for the alkanolamines yielded unworkable gels.

TABLE I

| | Ex. 9 | Ex. 10 | Ex. 11 | Ex. 12 |
|---|---|---|---|---|
| Stearic Acid | 5 | — | — | — |
| Oleic Acid | — | 5 | 5 | 5 |
| Triethanolamine | 5 | — | — | — |
| Diethanolamine | — | 5 | — | — |
| Monoethanolamine | — | — | 5 | — |
| 2-Amino-2-Methyl-1-Propanol | — | — | — | 5 |
| Ethoxylated (9 E.O.) Nonyl Phenol | 20 | 20 | 20 | 20 |
| Triethanolamine Borate | 5 | 5 | 5 | 5 |
| Ethylene Glycol Monobutyl Ether | 5 | 5 | 5 | 5 |
| Silicone Antifoam | 0.2 | 0.2 | 0.2 | 0.2 |
| Water | 59.8 | 59.8 | 59.8 | 59.8 |
| Rust Test | NVR | NVR | NVR | NVR |
| Humidity Test NVR | NVR | NVR | NVR | |
| Foam | None | None | None | None |
| Falex Test: | | | | |

TABLE I-continued

| | Ex. 9 | Ex. 10 | Ex. 11 | Ex. 12 |
|---|---|---|---|---|
| Units Wear | 2 | 0 | 3 | 2 |
| EP | 3650 | 3600 | 3500 | 3300 |
| Stain Test | NSS | NSS | NSS | NSS |

NVR = No Visible Rust
NSS = No Spotting or Staining

Omitting the fatty acid and/or alkanolamine from the formulation yields unacceptable products as is evidenced by the following comparative compositions:

| | Comp. D | Comp. E | Comp. F | Comp. G |
|---|---|---|---|---|
| Ethoxylated (9. E.O.) Nonyl Phenol | 20 | 25 | 20 | 20 |
| Oleic Acid | — | — | — | 10 |
| Triethanolamine | — | — | 10 | — |
| Triethanolamine Borate | 5 | 10 | 5 | 5 |
| Ethylene Glycol Monobutyl Ether | 5 | 5 | 5 | 5 |
| Silicone Antifoam | 0.2 | 0.2 | 0.2 | 0.2 |
| Water | 69.8 | 59.8 | 59.8 | 59.8 |

Product G was a gelatinous product which was imcompatible with water. Whereas Products D–F were clear solutions and were readily compatible with water to provide 5% aqueous solutions, the resulting test solutions had unacceptable lubricating properties and/or cleanability.

Product D gave severe spotting in the stain test and left substantial oily residue on the test panel in the cleaning test. Test solutions containing 5% of Products D, E and F all gave excessive wear in the Falex test—100, 80 and 80 units of wear, respectively.

EXAMPLE 13

To demonstrate the use of other hydroxylic compounds, the following cleaning composition was prepared:

| | Parts |
|---|---|
| Ethoxylated (9 E.O.) Nonyl Phenol | 20 |
| Triethanolamine Borate | 5 |
| Oleic Acid | 5 |
| Triethanolamine | 5 |
| Isopropyl Alcohol | 5 |
| Silicone Antifoam | 5 |
| Water | 59.8 |
| Rust Test | No Visible Rust |
| Humidity Test | No Visible Rust |
| Foam | None |
| Falex Test: | |
| Units Wear | 0 |
| EP | 3450 |
| Stain Test | No Spotting or Staining |
| Cleaning Test | No Visible Residue |

The above formulation was also prepared substituting ethanol, ethylene glycol, hexylene glycol, diethylene glycol and butyl carbitol for the isopropyl alcohol with comparable results.

EXAMPLE 14

For comparative purposes and to demonstrate the improved results obtained with the metal cleaning compositions of this invention, a metal cleaner composition was formulated based on the teachings of U.S. Pat. No. 4,395,365 as follows:

| | Percent |
|---|---|
| Sorbitan Monooleate | 25 |
| Ethoxylated (9 E.O.) Tridecyl Alcohol | 20 |
| EDTA | 3 |
| Nonylnaphthalene Sulfonic Acid Triethanolamine Salt | 3 |
| Propylene Glycol | 5 |
| Water | 46 |

The above-prepared formulation (identified as Comparative composition H) was diluted with water to obtain a 5% aqueous solution (5 parts of the concentrate in 95 parts water) and compared with a 5% aqueous solution of the product of Example 1. In the rust test, the aqueous solution prepared with product H gave heavy rust whereas there was not even the slightest trace of rust with the aqueous cleaner based on the product of Example 1. Similarly, in the humidity test heavy rusting developed after 24 hours using the solution containing product H. Using the solution containing the product of Example 1, there was no rust after 48 hours and only slight rust development was obtained after 72 hours. Results of the Falex test for the solutions containing product H and the product of Example 1 were 36 units wear/3400 EP and 10 units wear/3500 EP, respectively.

To demonstrate the superior cleaning ability of the products of this invention, a test was devised comparable to the procedure described in U.S. Pat. No. 4,395,365. Pre-weighed polished steel panels (1 inch×4 inch, RS-14, Q-Panel Co.) were coated with approximately 1 gram grease (NLGI grade 0) and then backweighed to determine the exact weight of the grease applied. The treated panels were sprayed for one minute with the 5% aqueous solutions maintained at a temperature of 60° C. The panels were then allowed to dry and reweighed to determine percent grease removal. Only 22.9% grease removal was achieved using the aqueous cleaner solution containing comparative product H, whereas 72.2% grease removal was realized using the aqueous cleaner solution containing the product of Example 1.

EXAMPLES 15–18

Additional metal cleaner compositions were prepared as follows:

| | Ex. 15 | Ex. 16 | Ex. 17 | Ex. 18 |
|---|---|---|---|---|
| Ethoxylated (9 E.O.) Nonyl Phenol | 10 | 30 | 7.5 | 5 |
| Oleic Acid | 3 | 3 | 2 | 7 |
| Triethanolamine | 3 | 3 | 3 | 7 |
| Triethanolamine Borate | 10 | 3 | 15 | 3 |
| Ethylene Glycol Monobutyl Ether | 10 | 5 | 5 | 7.5 |
| Silicone Antifoam | 0.5 | 0.25 | 0.1 | 0.1 |
| Water | 63.5 | 55.75 | 68.4 | 70.4 |

All of the products were clear liquids (pH 7–9.5) and were readily diluted with water to obtain clear, haze-free 5% aqueous solutions. All of the solutions had excellent foaming characteristics, i.e., the foam broke immediately, and exhibited superior cleaning ability. No residue was evident on any of the test panels coated with soybean oil or 105 SUS Pale oil and cleaned in accordance with the standard procedure. Also, there was no evidence of rust when the test solutions were evaluated in the rust test.

As previously indicated, any of the products obtained in accordance with the preceding examples may be utilized as such or may be further diluted with water. While the effectiveness of the products has typically been demonstrated utilizing 5% aqueous solutions, the concentrates may be combined with water in ratios ranging from 5:1 up to about 100:1 (water:concentrate). For most metal cleaning operations, however, the ratio of water to the cleaner composition will be from 10:1 to 50:1.

EXAMPLE 19

For comparative purposes and to demonstrate the unexpected results obtained with the products of this invention, in particular the surprising ability to obtain a non-greasy and non-sticky residue when an amine borate is employed in combination with the other major components, a series of aqueous solutions were prepared as follows:

Ex. 19: 10 parts of a concentrate as obtained in Example I 90 parts water (expressed in terms of the individual components the solution contained 0.5 part triethanolamine borate, 0.5 part ethylene glycol monobutyl ether, 0.5 part oleic acid, 0.5 part triethanolamine, 2 parts ethoxylated (9 E.O.) nonyl phenol, 0.02 part silicone antifoam, and 95.98 parts water)

Comp. I:
- 0.5 part triethanolamine borate
- 99.5 parts water

Comp. J:
- 0.5 part triethanolamine borate
- 3.5 parts ethylene glycol monobutyl ether
- 96 parts water Comp. K:
- 0.5 part triethanolamine borate
- 3.5 parts oleic acid
- 96 parts water Comp. L:
- 0.5 part triethanolamine borate
- 3.5 parts triethanolamine
- 96 parts water Comp. M:
- 0.5 part triethanolamine borate
- 1.75 parts oleic acid
- 1.75 parts triethanolamine
- 96 parts water Comp. N:
- 0.5 part triethanolamine borate
- 3.5 parts ethoxylated (9 E.O.) nonyl phenol
- 96 parts water.

Each of the above-prepared aqueous solutions was evaluated by adding 60 mls of the solution to a 3.75×0.5 inch Petri dish and allowing to air dry until the water was evaporated. The dishes were then examined and characterized as to the apparent residue, i.e. qualitative volume amount, and type of residue.

The following results were obtained:

| Product | Apparent Residue | Type of Residue |
|---|---|---|
| 19 | Slight | Viscous liquid; not greasy or sticky |
| I | Slight | Semi-solid; very sticky |
| J | Slight | Crusty, dry solid |
| K | Heavy | Viscous liquid; greasy |
| L | Medium | Viscous liquid; very sticky, slimey |
| M | Heavy | Viscous liquid; very sticky, slimey |
| N | Heavy | Viscous liquid; very sticky, slimey |

Even though each of the solutions contained the same amount of boramide (triethanolamine borate), the results obtained were significantly different. Each of the comparative solutions (I–N), which contained the boramide in conjunction with only one or two of the components required for the compositions of the invention, was unacceptable in one or more respects. The solutions prepared with products K, L, M and N all yielded more than desirable amounts of residue and the residues were either greasy or sticky. While the amount of residue obtained using the solutions prepared with I and J was not objectionable, the nature of these residues was unacceptable. It was only with the solution prepared using the concentrate of this invention (Ex. 19) that both the amount and nature of the residue was acceptable. It is truly surprising that satisfactory results are obtained with Ex. 19 in view of the fact that unacceptable residues are produced when the boramide is used by itself or in combination with each component individually.

I claim:

1. A multi-purpose metal cleaning composition comprising:
- (a) 5 to 40 parts by weight ethoxylated aliphatic alcohol or ethoxylated alkylphenol;
- (b) 4 to 20 parts by weight alkanolamine salt of a fatty acid;
- (c) 2 to 15 parts by weight boramide obtained by the reaction of boric acid or its analogs with a molar excess of alkanolamine selected from the group consisting of diethanolamine, diisopropanolamine and triethanolamine at a temperature of about 130° C. or above;
- (d) 2 to 15 parts by weight alcohol, glycol or ether glycol;
- (e) 0.05 to 2.5 parts by weight antifoam agent; and
- (f) 5 to 98 parts by weight water.

2. A multi-purpose metal cleaning composition according to claim 1 wherein (a) is a condensate of a $C_{6-18}$ aliphatic alcohol or alkylphenol having a $C_{6-18}$ alkyl substituent with 6 to 18 moles ethylene oxide.

3. A multi-purpose metal cleaning composition according to claim 2 wherein (b) is derived from a $C_{10-22}$ fatty acid and an alkanolamine selected from the group consisting of monoethanolamine, diethanolamine, triethanolamine, monoisopropanolamine, diisopropanolamine, triisopropanolamine, mono-sec-butanolamine, di-sec-butanolamine and tri-sec-butanolamine.

4. A multi-purpose metal cleaning composition according to claim 3 wherein (d) is a $C_{2-5}$ branched- or straight-chain alcohol, a $C_{2-8}$ branched- to straight-chain diol, or an ether glycol selected from the group consisting of diethylene glycol, triethylene glycol or tetraethylene glycol.

5. A multi-purpose metal cleaning composition according to claim 4 comprising 10 to 30 parts by weight (a), 6 to 16 parts by weight (b), 3 to 10 parts by weight (c), 3 to 10 parts by weight (d), 0.1 to 1.0 parts by weight (e) and 33 to 78 parts by weight (f).

6. An aqueous solution useful for degreasing and cleaning metal surfaces containing 1 part of the metal cleaner composition of claim 1 in from 5 to 100 parts water.

7. An aqueous solution according to claim 6 which contains from 10 to 50 parts water per part of the metal cleaner composition.

8. A metal cleaning composition comprised of 10 to 30 parts by weight ethoxylated (9 E.O.) nonyl phenol, 6 to 16 parts by weight triethanolamine salt of oleic acid, 3 to 10 parts by weight triethanolamine borate obtained by reacting boric acid with a molar excess of triethanolamine at a temperature of 130° C. or above, 3 to 10 parts by weight ethylene glycol monobutyl ether, 0.1 to 1.0 parts by weight silicone antifoam and 33 to 96 parts by weight water.

* * * * *